United States Patent [19]

Svendsen

[11] Patent Number: 4,547,152

[45] Date of Patent: Oct. 15, 1985

[54] DEVICE FOR HEATING THE BITUMEN LAYER OF ROLLED ROOFING MATERIAL

[76] Inventor: Find Svendsen, Solbergsgatan 9, S-664 00 Grums, Sweden

[21] Appl. No.: 610,293

[22] PCT Filed: Sep. 22, 1982

[86] PCT No.: PCT/SE82/00291

§ 371 Date: May 7, 1984

§ 102(e) Date: May 7, 1984

[87] PCT Pub. No.: WO84/01179

PCT Pub. Date: Mar. 29, 1984

[51] Int. Cl.[4] ..... F24J 3/00; F24J 3/02; F23C 5/00

[52] U.S. Cl. ..... 432/229; 126/271.1; 126/271.2 A; 432/222

[58] Field of Search ..... 432/222, 229; 126/271.1, 271.2 R, 271.2 A, 410

[56] References Cited

U.S. PATENT DOCUMENTS

| | | | |
|---|---|---|---|
| 2,084,625 | 6/1937 | Stebbins et al. | 432/229 |
| 2,532,567 | 12/1950 | Mott et al. | 432/229 |
| 2,836,409 | 5/1958 | Harrison | 432/222 |

*Primary Examiner*—John J. Camby

*Attorney, Agent, or Firm*—Murray, Whisenhunt and Ferguson

[57] ABSTRACT

A device for heating the bitumen layer of rolled roofing material in such a way that said layer becomes soft and sticky enough to adhere to the surface to be covered without burning said layer, comprising a distributing pipe (19) with many small closely distributed burner nozzles (20) for a combustible gas placed inside an elongated boxlike casing (9). The burner nozzles (20) form a row (10) inside the casing which is open at the front and rear. The plates (13, 14) and its width is considerably greater than its height while its length is considerably greater than its width. The distributing pipe (19) runs between the gable plates (13, 14) and is so positioned between and parallel to the top and the bottom plates that air slits (21, 22) are formed between the pipe and the top (11) and bottom (12) plates, respectively, said slits admitting air from the rear (17) of the casing to the nozzles (20). The heating assembly formed by the casing (9) and the distributing pipe (19) is equipped with wheels (24, 25) so as to facilitate moving the assembly and directing it as is desired.

5 Claims, 3 Drawing Figures

DEVICE FOR HEATING THE BITUMEN LAYER OF ROLLED ROOFING MATERIAL

FIELD OF THE INVENTION

The invention relates to a device for heating the bitumen layer of roofing material in order to make said layer soft and sticky enough to adhere to the surface which is being covered without burning said layer.

STATE OF THE ART

When applying roofing material burner elements are directed at the bitumen layer of the material in order to make this layer soft and sticky so that the material will adhere to the surface which is being covered. Heating is applied continuously as the roofing material is unrolled unto the surface with its bitumen layer towards the surface. Currently available burners generally have a few round nozzles. They do not function satisfactorily because the heating of the bitumen layer is uneven and the roofing material consequently may become scorched in places. As a result the overall result of applying roofing material is not satisfactory.

Larger devices have been developed with burner elements on a frame. Such devices are described in SE-181969 and in DE-OS No. 28 12 347. These devices are however constructed in a such a manner that the flames are directed towards or at least can come into contact with the bitumen layer which may catch fire. This is undesirable both because the adhesive properties of the bitumen will be impaired and because the heating is uneven as the coating is burned unevenly. These known devices are further part of larger apparatuses precluding the possibility of moving the heating device sideways or backwards and forwards in relation to the roll of roofing material. This movement is desirable in order to compensate for winds and in order to achieve the correct temperature in the bitumen layer.

DESCRIPTION OF THE INVENTION

The present invention aims at solving the above problems. A particular purpose is to present a device of low weight which is easy to maneuver in relation to the roll of roofing material and which heats the bitumen layer thereof with a jet of hot air rather than with open flames.

These and other purposes may be achieved by a device comprising the features mentioned in the patent claims to follow. Other characteristics and advantages of the invention will become apparent in the following description of a preferred embodiment.

BIREF DESCRIPTION OF DRAWINGS

The following description of a preferred embodiment will refer to the attached figures, of which FIG. 1 is a drawing in perspective illustrating the use of the device according to the invention, FIG. 2 is a drawing in perspective of a heating assembly, viewed from the front, which is a part of the device according to the invention, and FIG. 3 is a sectioned view of the heater according to FIG. 2 as sectioned along the line III—III.

DESCRIPTION OF A PREFERRED EMBODIMENT

Figure 1:
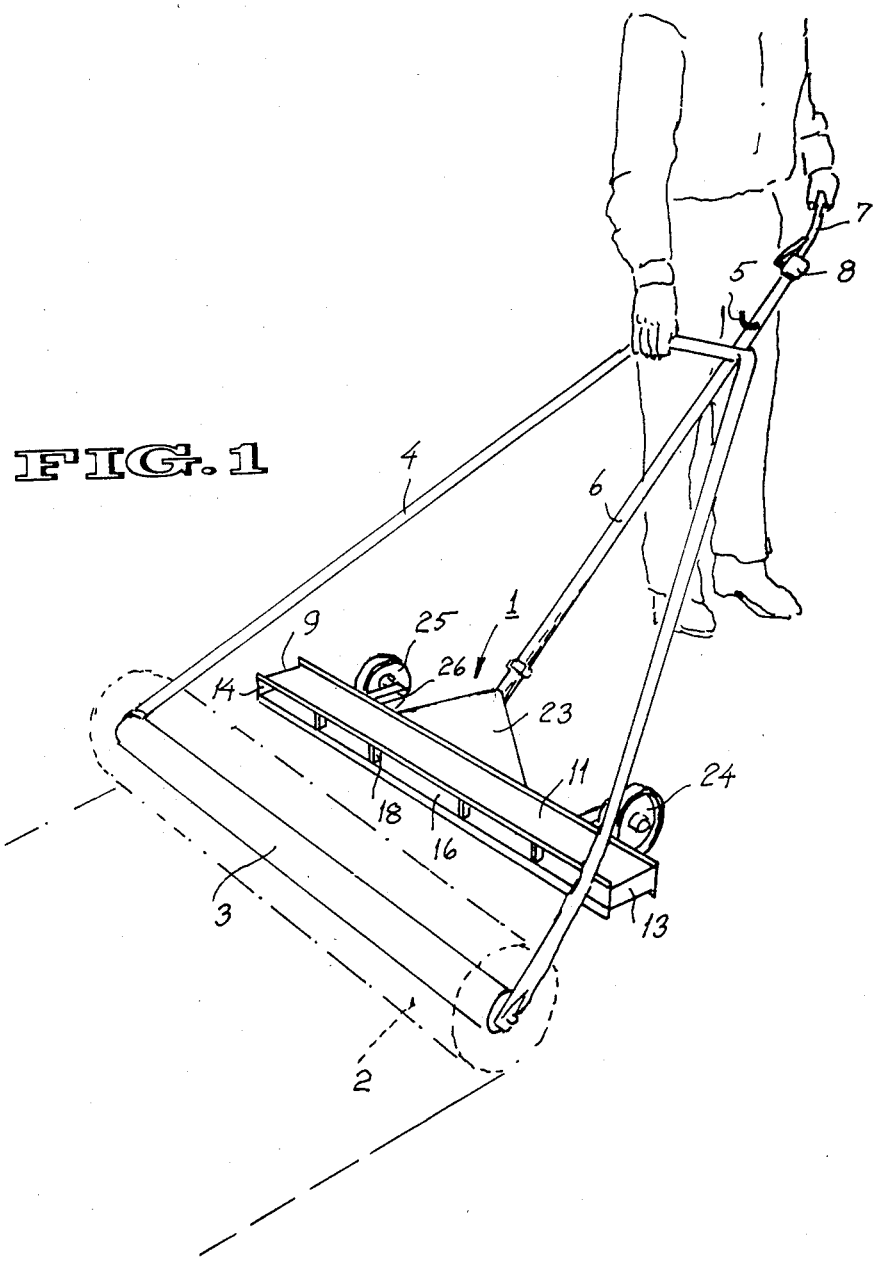
Figure 2:
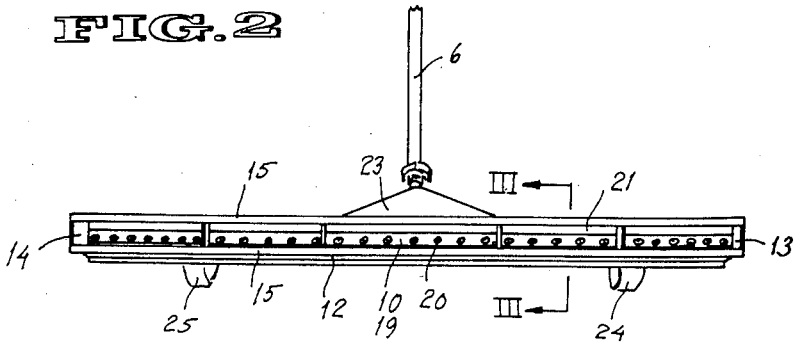
Figure 3:
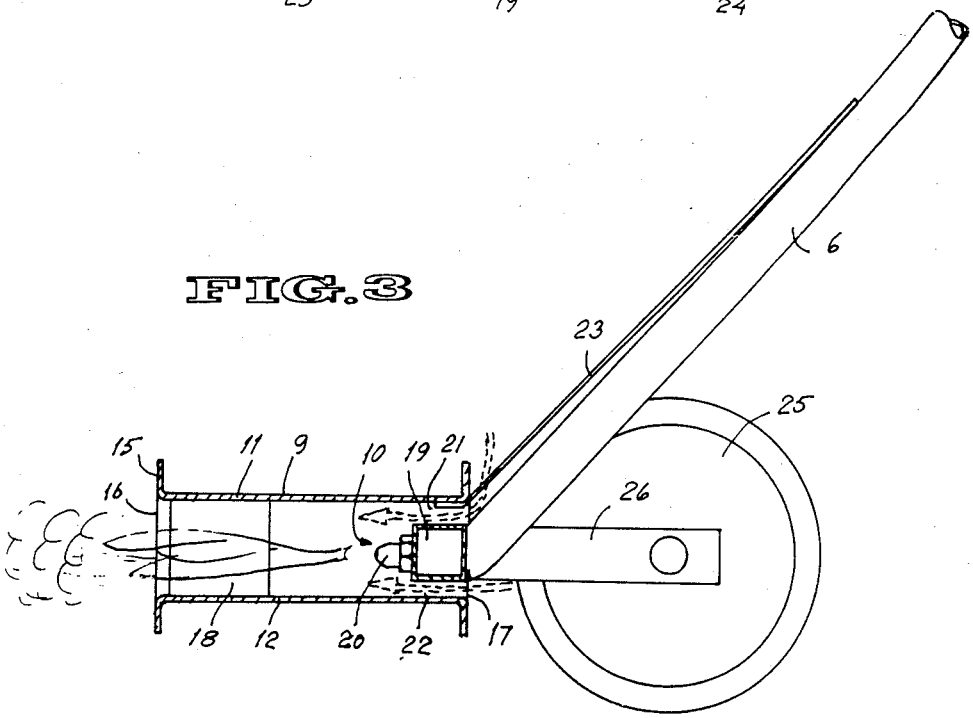

In FIG. 1 the heater is designated 1 and the roll of roofing material is designated 2. The latter is only indicated by ghost lines. A rod 3 goes through the center of the roll 2 and is journalled in the ends of a frame handle 4. The frame handle 4 may be hooked unto and connected loosely to the heater 1 by being placed in the hook 5 which is mounted on the pipe 6 which supplies the heater with gas. The gas hose is designated 7 and an on-off valve 8.

The heater consists of two main parts, the casing 9 and the nozzle row assembly 10. The casing 9 consists of an elongated boxlike frame with a top sheet 11, a bottom sheet 12 and gable plates 13 and 14. The top and bottom sheets are plane and parallel to each other and their front and rear edges 15 are folded up for greater rigidity. The length of the top and bottom sheets 11 and 12, in other words the distance between the gable plates 13 and 14, is considerably greater than the width of the casing 9, in other words the distance between the front 17 and the rear 16 of the casing. The height of the casing is also considerably less than its width. A number of distance and reinforcing steel plates 18 are distributed between the gable plates 13 and 14. The reinforcing plates 18 are placed in front of the nozzle row assembly 10 and are parallel to the gable plates. The casing 9 is open at both ends 16 and 17.

The nozzle row assembly 10 consists of a burner gas distributing pipe 19 and a number of nozzles 20 positioned close to each other at the front of the distributing pipe 19. The distributing pipe 19 runs along the whole length of the casing 9 and is attached to the gables 13 and 14. The pipe 19 is located at the back of the casing 9 centrally between the top and bottom sheets 11 and 12, so that an air slit 21 is formed between the pipe 19 and the top sheet 11 and a corresponding equally large slit between the pipe 19 and the bottom sheet 12. The burner gas supply pipe 6 is connected to the distributing pipe 19 19 at the center of the latter. The top sheet 11 and the gas supply pipe 6 are both welded to reinforcing plate 23 which adds to the necessary strength of the heater 1.

The heater 1 is also equipped with a pair of wheels 24 and 25, connected to distributing pipe 19 by a pair of rods 26.

When using the described device it is advisable to unroll the roll of roofing material 2 with one hand and to handle the heater 1 with the other as is illustrated in FIG. 1. It is convenient to keep the frame handle 4 free of the hook 5 in this mode of operation. The distance between the heater 1 and the roll 2 can then easily be adjusted and so can the position sideways of the heater relative to the roll in compensation for possible transverse winds, which can be strong, especially on taller buildings. By placing the nozzle row assembly centrally at the rear of the casing 9 with air slits 21 and 22 above and under the pipe 19 conditions are provided for a very efficient combustion within the casing 9 of the gases exciting the nozzles 20. The heater 1 will consequently mainly be producing only air of high temperature which can be directed at the bitumen layer of the roofing material with comparatively little turbulence.

I claim:

1. A device for the combustion of a combustible gas for heating without burning the bitumen layer of rolled roofing material to a temperature where the bitumen is so soft and sticky that it adheres to the surface to be covered, comprising:

a burner assembly comprising a box-like casing or frame, having a front opening and a rear opening spaced a predetermined distance from said front opening, consisting of a top sheet a bottom sheet and a pair of parallel gable plates, said pair of gable plates spaced a predetermined distance apart from one another, each of said gable plates connected to said top sheet and said bottom sheet, said gable plates holding said top sheet and said bottom in parallel and spaced apart from one another by a predetermined distance, said distance between said front and rear openings being greater than said distance between said top and bottom sheets, said distance between said gable plates being greater than said distance between said front and rear openings; and a distributing pipe, fitted with a plurality of closely distributed burner nozzles disposed in a row, for said combustible gas, said distributing pipe disposed within said casing and extending from one gable plate to the other gable plate, said distributing pipe being parallel to and spaced apart from each of said top sheet and said bottom sheet, said spaces between said top sheet and said distributing pipe and said bottom sheet and said distributing pipe forming respective air slits, said air slits admitting air from the rear opening of the casing to the burner nozzles; and wheel means, connected to said burner assembly, for supporting said burner assembly for rolling movement on said surface to direct said burner in a desired manner.

2. The device according to claim 1, wherein said burner nozzles are spaced rearwardly from said front opening.

3. The device according to claim 1, wherein said distributing pipe is disposed within said casing adjacent said rear opening.

4. The device according to claim 1, wherein said top and bottom sheets are plane.

5. The device according to claim 4, wherein vertical reinforcing plates or the like parallel to said gable plates are positioned between said top and bottom sheets in front of said row of burner nozzles.

* * * * *